US010287750B2

(12) United States Patent
Wang et al.

(10) Patent No.: US 10,287,750 B2
(45) Date of Patent: May 14, 2019

(54) ROTATORY ENERGY RECYCLING CONTROL DEVICE FOR HYDRAULIC EXCAVATOR

(71) Applicant: XUZHOU XUGONG EXCAVATOR MACHINERY CO., LTD, Xuzhou (CN)

(72) Inventors: Zhenxing Wang, Xuzhou (CN); Zong Li, Xuzhou (CN); Jiasheng Qin, Xuzhou (CN); Shuhui Fei, Xuzhou (CN); Jijiang Shi, Xuzhou (CN); Jianchang Gao, Xuzhou (CN); Benqiang Sun, Xuzhou (CN); Zhipeng Li, Xuzhou (CN); Yang Zheng, Xuzhou (CN)

(73) Assignee: XUZHOU XUGONG EXCAVATOR MACHINERY CO., LTD, Xuzhou (CN)

( * ) Notice: Subject to any disclaimer, the term of this patent is extended or adjusted under 35 U.S.C. 154(b) by 316 days.

(21) Appl. No.: 15/024,901

(22) PCT Filed: Aug. 13, 2014

(86) PCT No.: PCT/CN2014/084230
§ 371 (c)(1),
(2) Date: Mar. 25, 2016

(87) PCT Pub. No.: WO2015/055042
PCT Pub. Date: Apr. 23, 2015

(65) Prior Publication Data

US 2016/0289925 A1 Oct. 6, 2016

(30) Foreign Application Priority Data

Oct. 15, 2013 (CN) ..... 2013 1 0482136

(51) Int. Cl.
*E02F 9/22* (2006.01)
*E02F 9/12* (2006.01)
(Continued)

(52) U.S. Cl.
CPC ..... *E02F 9/2217* (2013.01); *E02F 9/123* (2013.01); *E02F 9/2267* (2013.01); *F15B 1/027* (2013.01);
(Continued)

(58) Field of Classification Search
CPC ..... E02F 9/123; E02F 9/2217; E02F 9/2267; F15B 1/027; F15B 21/14
(Continued)

(56) References Cited

U.S. PATENT DOCUMENTS 4,739,616 A * 4/1988 Myers ..... F04B 49/08 60/420
5,709,282 A * 1/1998 Akira ..... F16H 61/4069 180/307
(Continued)

FOREIGN PATENT DOCUMENTS

CN 201746870 U 2/2011
CN 102733442 A 10/2012
(Continued)

OTHER PUBLICATIONS

The World Intellectual Property Organization (WIPO) International Search Report for PCT/CN2014/084230 dated Nov. 15, 2014.

*Primary Examiner* — Thomas E Lazo
*Assistant Examiner* — Richard C Drake
(74) *Attorney, Agent, or Firm* — Anova Law Group, PLLC

(57) ABSTRACT

A rotatory energy recycling control device for a hydraulic excavator, comprising: an oil line selector valve (1), a direction selector valve (2), a sequencing valve (3), a
(Continued)

one-way valve (4) and an overflow valve (5); two oil inlets of the oil line selector valve (1) are respectively connected to an opening A and an opening B of a rotary motor; an oil outlet of the oil line selector valve (1) is connected to an inlet of the direction selector valve (2); an outlet of the direction selector valve (2) is connected to an net of the sequencing valve (3); a drainage port of the sequencing valve (3) is connected to an oil tank; an outlet of the sequencing valve (3) and an net of the one-way valve (4) communicate with the overflow valve (5): the outlet of the one-way valve (4) is connected to an energy storage and utilization device; and an outlet of the overflow valve (5) is connected to the oil tank. One device can simultaneously achieve energy recycling from rotatory start and deceleration braking with fewer components and simplified piping designs.

5 Claims, 1 Drawing Sheet

(51) Int. Cl.
*F15B 1/027* (2006.01)
*F15B 21/14* (2006.01)

(52) U.S. Cl.
CPC ..... *F15B 21/14* (2013.01); *F15B 2211/7058* (2013.01)

(58) Field of Classification Search
USPC ..... 60/414; 180/165
See application file for complete search history.

(56) References Cited

U.S. PATENT DOCUMENTS 5,813,312 A * 9/1998 Arai ..... E02F 9/2242 60/422
6,009,708 A * 1/2000 Miki ..... E02F 9/123 60/414
6,971,463 B2 12/2005 Shore et al.
7,240,486 B2 * 7/2007 Huang ..... F16D 31/00 60/413
7,444,809 B2 * 11/2008 Smith ..... E02F 9/2217 60/413
7,614,226 B2 * 11/2009 Legner ..... F16H 61/421 60/483
7,905,088 B2 * 3/2011 Stephenson ..... E02F 9/2217 60/414
8,577,560 B2 * 11/2013 Kawasaki ..... B60W 10/30 180/65.265
8,622,365 B2 * 1/2014 Fukano ..... F16K 7/045 251/7
8,726,645 B2 * 5/2014 Shang ..... E02F 9/123 60/414
8,806,860 B2 * 8/2014 Kawasaki ..... E02F 9/2075 251/282
8,807,155 B2 * 8/2014 Kawasaki ..... B60W 30/188 137/115.25
9,091,040 B2 * 7/2015 Peterson ..... F16H 61/431
9,200,430 B2 * 12/2015 Kawasaki ..... E02F 9/2217
9,593,467 B2 * 3/2017 Kajita ..... F15B 21/14
9,664,209 B2 * 5/2017 Kawasaki ..... F15B 11/024
2010/0018200 A1 * 1/2010 Prigent ..... F16H 61/4017 60/484
2011/0168933 A1 * 7/2011 Shimizu ..... H01F 7/127 251/129.15
2015/0165887 A1 * 6/2015 Krittian ..... B60K 6/12 60/414
2015/0323092 A1 * 11/2015 Yakushijin ..... F16K 31/1221 137/484.2
2016/0237648 A1 * 8/2016 Kawasaki ..... F15B 21/14
2016/0319635 A1 * 11/2016 Du ..... E21B 43/12
2016/0376770 A1 * 12/2016 Matsuzaki ..... E02F 9/2217 60/414
2017/0204887 A1 * 7/2017 Matsuzaki ..... E02F 9/22

FOREIGN PATENT DOCUMENTS

CN 103556669 A 2/2014
CN 203613592 U 5/2014
JP S6367403 A 3/1988

* cited by examiner

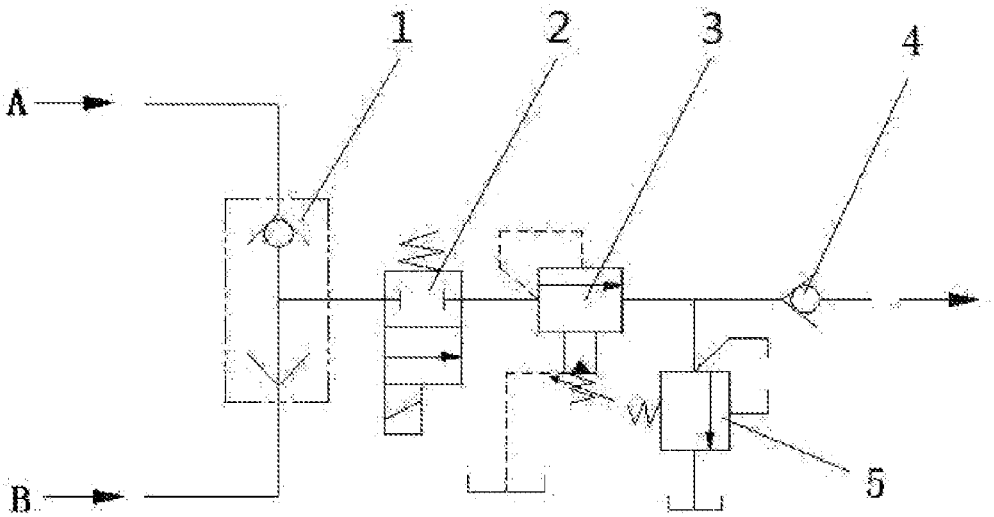
1
2
3
4
A
B
5

ROTATORY ENERGY RECYCLING CONTROL DEVICE FOR HYDRAULIC EXCAVATOR

CROSS REFERENCE TO RELATED APPLICATIONS

This application claims priority to International Application No. PCT/CN2014/084230, filed on Aug. 13, 2014, which claims priority to Chinese Patent Application No. 201310482136.6, filed on Oct. 15, 2013, all of which are incorporated herein by reference in their entirety.

TECHNICAL FIELD

The present disclosure generally relates to the technical field including hydraulic rotatory mechanism including a rotatory energy recycling control device and, more particularly, relates to a rotatory energy recycling control device for hydraulic excavators, suitable for a hydraulic excavator including a hydraulic rotatory system.

BACKGROUND ART

Hydraulic excavators are featured with wide application range, large energy consumption, and strong periodicity in operation. Energy-saving technology researches for hydraulic excavators have great economic value and feasibility. When a traditional hydraulic excavator is in rotatory start and deceleration braking, the rotatory start and deceleration braking torque is determined by an overflow pressure that is set by the rotatory overflow valve. During the rotatory start process, because the flow rate provided by the hydraulic pump is greater than the flow rate needed by the rotary motor, overflow loss from the rotatory start may be generated. During the rotatory deceleration braking process, because the deceleration braking effect is achieved by a deceleration braking torque produced by a reversing back pressure of the rotatory overflow value, overflow loss from the rotatory deceleration braking may be generated. The overflow oil may produce a large amount of heat energy, which heats the hydraulic system of the excavator, and reduces performance and lifetime of the hydraulic system. Since the excavator operation has strong periodicity characteristics, the rotatory action may be much frequently performed. This causes severe energy loss. If the energy loss can be recycled and reused, considerable economic benefits can be obtained.

Chinese patent application No. CN101736771 A discloses a rotatory deceleration braking energy recycling system of a hydraulic excavator. Such energy recycling system only recovers overflow energy from the rotatory deceleration braking, and does not recover overflow energy from the rotatory start. Chinese patent application No. CN 102733442 discloses a hydraulic excavator rotatory energy recycling system of a hydraulic excavator. Such system uses a three-position three-way directional valve to respectively recycle energy from a forward rotation and a reverse rotation. However, the response time of the directional valve may affect energy recycling and the rotation performance. There are also some devices that create back pressure during energy recycling, by using an energy storage device such as an energy accumulator, or using an energy utilization device such as a hydraulic motor. However, the back pressure created in this manner is unstable and affects performance of the rotatory system of the hydraulic excavator.

INVENTION DISCLOSURE

Technical Problem

Hydraulic excavators are featured with wide application range, large energy consumption, and strong periodicity in operation. Energy-saving technology researches for hydraulic excavators have great economic value and feasibility. When a traditional hydraulic excavator is in rotatory start and deceleration braking, the rotatory start and deceleration braking torque is determined by an overflow pressure that is set by the rotatory overflow valve. During the rotatory start process, because the flow rate provided by the hydraulic pump is greater than the flow rate needed by the rotary motor, overflow loss from the rotatory start may be generated. During the rotatory deceleration braking process, because the deceleration braking effect is achieved by a deceleration braking torque produced by a reversing back pressure of the rotatory overflow value, overflow loss from the rotatory deceleration braking may be generated. The overflow oil may produce a large amount of heat energy, which heats the hydraulic system of the excavator, and reduces performance and lifetime of the hydraulic system. Since the excavator operation has strong periodicity characteristics, the rotatory action may be much frequently performed. This causes severe energy loss.

Technical Solution

One object of the present invention provides a rotatory energy recycling control device for a hydraulic excavator. The disclosed device is capable of automatically recycling overflow energy during rotatory start and deceleration braking processes. The recycling of overflow energy may have small impact on performance of the original system of the hydraulic excavator.

To solve the above technical problems, the present invention provides a technical solution as follows: a rotatory energy recycling control device for a hydraulic excavator, including: an oil line selector valve, a direction selector valve, a sequencing valve, a one-way valve and an overflow valve; two oil inlets of the oil line selector valve are respectively connected to an opening A and an opening B of a rotary motor; an oil outlet of the oil line selector valve is connected to an inlet of the direction selector valve; an outlet of the direction selector valve is connected to an inlet of the sequencing valve; a drainage port of the sequencing valve is connected to an oil tank; an outlet of the sequencing valve and an inlet of the one-way valve communicate with the overflow valve; the outlet of the one-way valve is connected to an energy storage and utilization device; an outlet of the overflow valve is connected to the oil tank.

As a further improvement of the present invention, the oil line selector valve is a shuttle valve.

As a further improvement of the present invention, the oil line selector valve is composed of two one-way valve components.

As a further improvement of the present invention, the direction selector valve is a solenoid directional valve, a hydraulically operated directional valve, an electrical proportional directional valve, or a manually operated directional valve.

As a further improvement of the present invention, the one-way valve includes a logic valve with a reverse blocking function.

As a further improvement of the present invention, the overflow valve is mounted on the energy storage and utilization device.

Advantageous Effects

The disclosed rotatory energy recycling control device may recycle both rotatory start overflow energy and rotatory deceleration braking overflow energy. In addition, without compromising the original action performance of the hydraulic excavator, the disclosed rotatory energy recycling control device can recycle both rotatory start overflow energy and rotatory deceleration braking overflow energy. An oil line selector valve may be used to select from the high-pressure oil lines of inlet and outlet of the rotary motor with a fast response and a simple structure. Establishment of a system back pressure may be adjusted and set by an operating pressure of a sequencing valve. The operating pressure of the sequencing valve may be set according to the overflow pressure of the original rotatory system such that performance of the rotatory system remains unchanged. A direction selector valve may be added to more conveniently enable or disable the energy recycling system, which facilitates realization of automation. The present invention uses such a device to simultaneously achieve energy recycling for rotatory start and deceleration braking, which changes unicity of energy recycling of rotatory overflow of existing excavators. The disclosed rotatory energy recycling control device uses fewer components, simplifies piping design, plays an important role on overflow energy recycling, greatly reduces oil waste, saves cost, and facilitates operation.

DESCRIPTION OF DRAWINGS

FIG. 1 is a schematic structure of the present invention, where, 1 is an oil line selector valve, 2 is a direction selector valve, 3 is a sequencing valve, 4 is a one-way valve, and 5 is an overflow valve.

BEST MODE

The present disclosure is described as follows: the oil passage selector valve 1 is preferably a shuttle valve, and the direction selector valve 2 is preferably a solenoid directional valve.

As shown in FIG. 1, a rotatory energy recycling control device for a hydraulic excavator includes an oil line selector valve 1, a direction selector valve 2, a sequencing valve 3, a one-way valve 4 and an overflow valve 5; two oil inlets of the shuttle valve are respectively connected to opening A and opening B of a rotary motor, an oil outlet of the shuttle valve is connected to an inlet of the solenoid directional valve, an outlet of the solenoid directional valve is connected to an inlet of the sequencing valve 3, a drainage port of the sequencing valve 3 is connected to an oil tank, an outlet of the sequencing valve 3 and an inlet of the one-way valve 4 communicate with the overflow valve 5, the outlet of the one-way valve 4 is connected to an energy storage and utilization device, an outlet of the overflow valve 5 is connected to the oil tank. The overflow valve 5 is mounted on the energy storage and utilization device to provide compact, simplified structure without using extra connecting means.

In the above-described embodiment, the oil line selector valve 1 may be formed by two one-way valves, and used to select from high-pressure oil lines of inlet and outlet of the rotary motor;

The direction selector valve 2 can also be replaced with a direction selector valve, an electrical proportional directional valve, or a manually operated directional valve; and can be used to enable or disable the rotatory energy recycling control device to facilitate realization of automatic control;

The start pressure and operating characteristics of the sequencing valve 3 may be similar to the start pressure and operating characteristics of the original rotatory system to ensure that the addition of the energy recycling control device may not reduce system performance;

The one-way valve 4 may choose to use a logic valve with a reverse blocking function to avoid damage or adverse effects on the system due to reflux of the recycled high-pressure oil; and The overflow valve 5 is used to limit the maximum pressure of the recycled oil to protect the system.

The present invention provides working principle as follows: the disclosed rotatory energy recycling control device, without compromising the original action performance of the hydraulic excavator, can recycle energy from rotatory start and rotatory deceleration braking. When the rotatory energy recycling control device is in operation, the direction selector valve 2 is turned on. When the rotation starts, because the flow rate of the rotary motor is less than the flow rate outputted from the pump, pressure at the inlet of the rotary motor increases. At this point, high-pressure oil at the inlet of the rotary motor may communicate with the inlet of the sequencing valve 3 through the oil line selector valve 1 and the direction selector valve 2. When the high-pressure oil has a pressure reaching a pressure set by the sequencing valve 3, the sequencing valve 3 opens, the excess high-pressure oil of the system flows through the sequencing valve 3 and the one-way valve 4 into the energy storage device or energy utilization device. Starting torque of the rotary motor is pressure-guaranteed by the sequencing valve 3. During the rotary braking, the rotary motor is in the pump-working condition, at this point, outlet pressure of the rotary motor increases, and the inlet pressure decreases. High-pressure oil at the outlet of the rotary motor flows through the oil line selector valve 1 and the direction selector valve 2, and is connected to inlet of the sequencing valve 3. When the high-pressure oil has a pressure reaching a pressure set by the sequencing valve 3, the sequencing valve 3 opens. The excess high-pressure oil of the system flows through the sequencing valve 3 and the one-way valve 4 into the energy storage device or energy utilization device. Braking torque of the rotary motor may be pressure-guaranteed by the sequencing valve 3, the maximum recycling pressure of the device may be adjusted and set by the overflow valve 5.

What is claimed is:

1. A rotatory energy recycling control device for a hydraulic excavator, comprising:

an oil line selector valve, a direction selector valve, a sequencing valve, a one-way valve and an overflow valve; wherein:

two oil inlets of the oil line selector valve are respectively connected to a first opening and a second opening of a rotary motor;

an oil outlet of the oil line selector valve is connected to an inlet of the direction selector valve;

an outlet of the direction selector valve is connected to an inlet of the sequencing valve;

a drainage port of the sequencing valve is connected to an oil tank;

an outlet of the sequencing valve is directly communicated with the overflow valve, and an inlet of the one-way valve is directly communicated with the overflow valve;

an outlet of the one-way valve is connected to an energy storage and utilization device; and an outlet of the overflow valve is connected to the oil tank.

2. The rotatory energy recycling control device for the hydraulic excavator according to claim 1, wherein the oil line selector valve is a shuttle valve.

3. The rotatory energy recycling control device for the hydraulic excavator according to claim 1, wherein the oil line selector valve is composed of two one-way valves.

4. The rotatory energy recycling control device for the hydraulic excavator according to claim 1, wherein the direction selector valve is one of a solenoid directional valve, a hydraulically operated directional valve, an electrical proportional directional valve, and a manually operated directional valve.

5. The rotatory energy recycling control device for the hydraulic excavator according to claim 1, wherein the overflow valve is mounted on the energy storage and utilization device without using extra connecting means.

* * * * *